US011280063B2

(12) United States Patent
Imaizumi et al.

(10) Patent No.: US 11,280,063 B2
(45) Date of Patent: Mar. 22, 2022

(54) WORK VEHICLE CONTROL SYSTEM AND WORK VEHICLE CONTROL METHOD

(71) Applicant: Komatsu Ltd., Tokyo (JP)

(72) Inventors: Masaaki Imaizumi, Tokyo (JP); Makoto Naito, Tokyo (JP)

(73) Assignee: Komatsu Ltd., Tokyo (JP)

( * ) Notice: Subject to any disclaimer, the term of this patent is extended or adjusted under 35 U.S.C. 154(b) by 749 days.

(21) Appl. No.: 16/096,896

(22) PCT Filed: Jun. 19, 2018

(86) PCT No.: PCT/JP2018/023273
§ 371 (c)(1),
(2) Date: Oct. 26, 2018

(87) PCT Pub. No.: WO2018/199342
PCT Pub. Date: Nov. 1, 2018

(65) Prior Publication Data

US 2021/0222401 A1 Jul. 22, 2021

(51) Int. Cl.
*E02F 9/22* (2006.01)
*E02F 3/43* (2006.01)

(52) U.S. Cl.
CPC ..... *E02F 9/2246* (2013.01); *E02F 3/431* (2013.01); *E02F 9/221* (2013.01)

(58) Field of Classification Search
CPC . E02F 9/2292; E02F 3/32; E02F 9/265; E02F 3/432; E02F 3/433; E02F 3/434;
(Continued)

(56) References Cited

U.S. PATENT DOCUMENTS 5,701,793 A * 12/1997 Gardner ..... E02F 3/431 60/327
5,737,993 A * 4/1998 Cobo ..... E02F 3/431 60/327

(Continued)

FOREIGN PATENT DOCUMENTS

GB 2312762 A 11/1997
JP 04-237726 A 8/1992

(Continued)

OTHER PUBLICATIONS

Supplementary European Search Report dated Feb. 25, 2020, issued in the corresponding European patent application No. 18785493.0.

(Continued)

*Primary Examiner* — Edwin J Toledo-Duran
(74) *Attorney, Agent, or Firm* — Locke Lord LLP

(57) ABSTRACT

A work vehicle control system includes: a hydraulic device configured to adjust a supply state of hydraulic fluid supplied to a hydraulic cylinder configured to cause a work tool to operate; and a control device configured to control the hydraulic device. The control device includes: an operation data acquisition unit configured to acquire operation data indicating an operation state of an operating device operated in order to cause a work tool to perform dumping and tilting movements; and a control command unit configured to output, based on the operation data, a control command to control the hydraulic device; an operating condition determination unit configured to determine, based on the operation data, whether the operating device is operated under prescribed operating conditions; and a limit command unit configured to output a limit command to limit the control command when the operating device is determined to be operated under the operating conditions.

10 Claims, 9 Drawing Sheets

(58) Field of Classification Search
CPC ..... E02F 9/2235; E02F 9/2296; E02F 9/2246; E02F 3/431; E02F 9/221; E02F 9/20; F15B 19/005; F15B 19/007; F15B 2211/50518; F15B 2211/6309; F15B 2211/633; F15B 2211/634; F15B 2211/6346; F15B 2211/6651; F15B 2211/6652; F15B 2211/88; F01N 2900/08; F01N 2900/1622; F01N 3/208; F02D 2041/001; F02D 41/0002; F02D 41/0055; F02D 41/028; F03C 1/0678; F04B 1/26; F04B 2205/06; F04B 2205/09; F04B 23/06; F04B 49/065; F04B 49/08; F04B 49/22; Y02T 10/18; Y02T 10/24; Y02T 10/42
See application file for complete search history.

(56) References Cited

U.S. PATENT DOCUMENTS

| | | | | |
|---|---|---|---|---|
| 5,875,701 | A * | 3/1999 | Cobo | E02F 3/431 91/361 |
| 5,999,872 | A | 12/1999 | Kinugawa et al. | |
| 6,234,254 | B1 * | 5/2001 | Dietz | A01B 67/00 172/3 |
| 6,618,659 | B1 * | 9/2003 | Berger | E02F 3/431 172/12 |
| 9,074,546 | B2 * | 7/2015 | Asami | E02F 9/2292 |
| 9,133,780 | B2 * | 9/2015 | Asami | E02F 9/2079 |
| 9,938,694 | B2 * | 4/2018 | Matsuyama | E02F 9/2033 |
| 10,196,796 | B2 * | 2/2019 | Iwamura | E02F 9/2033 |
| 10,815,640 | B2 * | 10/2020 | Naito | E02F 9/2033 |
| 2004/0176894 | A1 | 9/2004 | Alexader et al. | |
| 2008/0227596 | A1 * | 9/2008 | Schifferer | E02F 9/2246 477/52 |
| 2008/0295679 | A1 * | 12/2008 | Callaghan | E02F 9/2207 91/1 |
| 2009/0084192 | A1 * | 4/2009 | Budde | F15B 11/162 73/861.04 |
| 2010/0031650 | A1 * | 2/2010 | Morinaga | B60L 50/16 60/459 |
| 2012/0310494 | A1 * | 12/2012 | Asami | B60W 10/30 701/50 |
| 2013/0041561 | A1 * | 2/2013 | Asami | E02F 9/0841 701/50 |
| 2017/0002546 | A1 * | 1/2017 | Fletcher | E02F 9/261 |
| 2017/0275848 | A1 * | 9/2017 | Marquette | E02F 3/434 |
| 2017/0284070 | A1 * | 10/2017 | Matsuyama | E02F 9/20 |
| 2018/0100290 | A1 | 4/2018 | Greer | |
| 2018/0142441 | A1 * | 5/2018 | Berry | E02F 9/265 |
| 2018/0179739 | A1 * | 6/2018 | Berry | G01L 1/02 |
| 2019/0112788 | A1 * | 4/2019 | Enomoto | B60W 30/186 |
| 2019/0161940 | A1 * | 5/2019 | Takeda | F16H 61/4008 |

FOREIGN PATENT DOCUMENTS

| | | | |
|---|---|---|---|
| JP | 08-042507 | A | 2/1996 |
| JP | 09-217702 | A | 8/1997 |
| JP | 2000-136801 | A | 5/2000 |
| WO | 2005/100701 | A1 | 10/2005 |

OTHER PUBLICATIONS

International Search Report dated Aug. 21, 2018, issued for PCT/JP2018/023273.

* cited by examiner

WORK VEHICLE CONTROL SYSTEM AND WORK VEHICLE CONTROL METHOD

FIELD

The present invention relates to a work vehicle control system and a work vehicle control method.

BACKGROUND

A work vehicle performs excavating work, loading work, and unloading work of earth and sand by using a bucket of a work machine. For example, when the earth and sand are dumped from a bucket in the loading work, an operator of the work vehicle operates an operating device such that the bucket performs a dumping movement. In a case where the earth and sand remaining after the dumping movement adhere to the bucket, the operator may quickly operate the operating device in a reciprocating manner in a full operation range of the operating device such that the bucket repeats the dumping movement and a tilting movement in order to shake off the earth and sand adhering to the bucket. When the operating device is quickly operated in a reciprocating manner in the full operation range, the bucket performs a reciprocating motion between an operating limit position (stroke end) of the dumping movement and an operating limit position (stroke end) of the tilting movement.

CITATION LIST

Patent Literature

Patent Literature 1: Japanese Laid-open Patent Publication No. 08-042507 A

SUMMARY

Technical Problem

Even when an operating device is operated in a reciprocating manner in a full operation range, a large load does not act on a work machine as far as a reciprocating motion of a bucket is slowly repeated over time between an operating limit position of a dumping movement and an operating limit position of a tilting movement. However, when the operating device is quickly operated in a reciprocating manner in the full operation range and the reciprocating motion of the bucket is repeated between the operating limit position of the dumping movement and the operating limit position of the tilting movement in a short period of time, an excessive load is given to at least a part of the work machine at the operating limit position of the dumping movement or the operating limit position of the tilting movement. In such a case, it is necessary to prepare a work machine to which a structure or a material that can withstand the load is applied, thereby causing weight increase or cost increase of the work machine. Additionally, in a case where the work machine cannot withstand the load, the work machine may be damaged.

An aspect of the present invention is to reduce a load acting on the work machine.

Solution to Problem

According to an aspect of the present invention, a work vehicle control system comprises: a hydraulic device configured to adjust a supply state of hydraulic fluid supplied to a hydraulic cylinder configured to cause a work tool to operate; and a control device configured to control the hydraulic device, wherein the control device includes:

an operation data acquisition unit configured to acquire operation data indicating an operation state of an operating device operated in order to cause the work tool to perform a dumping movement and a tilting movement; a control command unit configured to output a control command to control the hydraulic device on the basis of the operation data; an operating condition determination unit configured to determine, on the basis of the operation data, whether the operating device is operated under prescribed operating conditions; and a limit command unit configured to output a limit command to limit the control command in a case where it is determined that the operating device is operated under the operating conditions, wherein the operation data includes; an operation amount of the operating device to cause the work tool to perform the dumping movement or the tilting movement; an operating direction of the operating device to cause the work tool to perform the dumping movement or the tilting movement, and an operation time of the operating device required to switch the work tool from one movement out of the dumping movement and the tilting movement to the other movement, and the operating conditions include: a first condition in which the operation amount is an operation amount threshold value or more; a second condition in which the operation direction is switched prescribed number of times; and a third condition in which the operation time is an operation time threshold value or less.

Advantageous Effects of Invention

According to the aspect of the present invention, it is possible to reduce a load acting on the work machine.

DESCRIPTION OF EMBODIMENTS

An embodiment of the present invention will be described below with reference to the drawings, but the present invention is not limited thereto. Note that constituent elements of the embodiment described below can be suitably combined. Additionally, some of the constituent elements may not be used.

[Work Vehicle]

Figure 1:
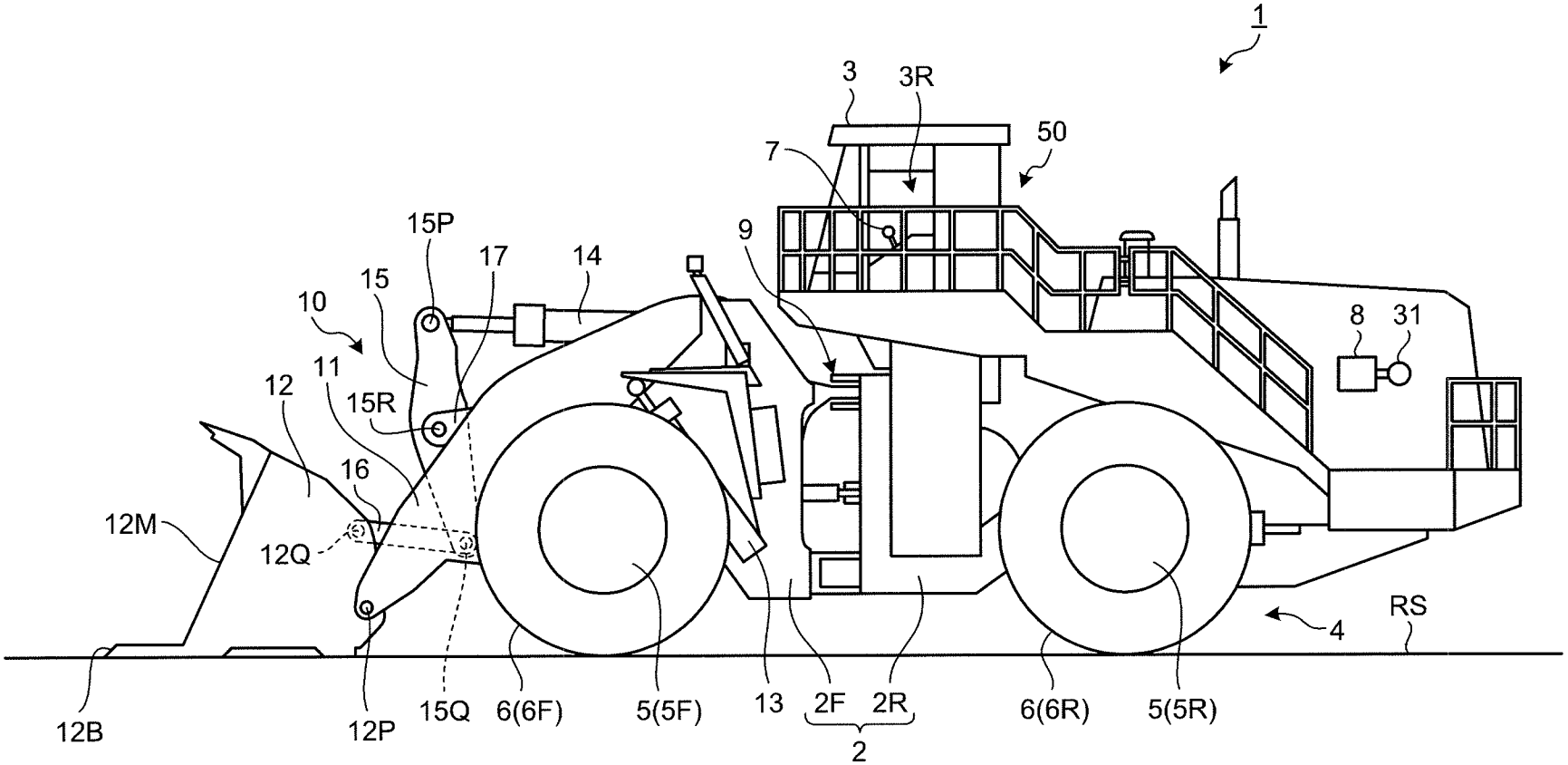
FIG. 1 is a side view illustrating a work vehicle according to an embodiment.

FIG. 1 is a side view illustrating a work vehicle 1 according to the present embodiment. In the present embodiment, a work vehicle 1 is a wheel loader 1 that is a kind of an articulate work vehicle. The wheel loader 1 loads, on a hauling vehicle, earth and sand scooped up by a bucket 12 serving as a work tool, and unloads the earth and sand in a predetermined place.

As illustrated in FIG. 1, the wheel loader 1 includes a vehicle body 2, a cab 3, a travel device 4, a work machine 10, and a control system 50.

The vehicle body 2 includes a vehicle body front portion 2F and a vehicle body rear portion 2R. The cab 3 is supported by the vehicle body 2. An operating room 3R is provided at the cab 3. The wheel loader 1 is operated by an operator who boards the operating room 3R.

The travel device 4 supports the vehicle body 2. An articulation mechanism 9 connects the vehicle body front portion 2F to the vehicle body rear portion 2R in a bendable manner. The articulation mechanism 9 includes a steering cylinder. The vehicle body 2 is bent by extension/contraction of the steering cylinder. The wheel loader 1 is swung by the vehicle body 2 being bent. Wheels 5 are rotate by power generated by an engine 8 mounted on the vehicle body 2. Tires 6 are respectively attached to the wheels 5. The wheels 5 include: two front wheels 5F supported by the vehicle body front portion 2F; and two rear wheels 5R supported by the vehicle body rear portion 2R. The tires 6 include: front tires 6F attached to the front wheels 5F; and rear tires 6R attached to the rear wheels 5R. With rotation of the wheels 5, the wheel loader 1 travels on ground RS.

The work machine 10 is supported by the vehicle body front portion 2F. The work machine 10 includes a boom 11 connected to the vehicle body 2 in a shakable manner, a bucket 12 connected to the boom 11 in a shakable manner, a bell crank 15, and a bucket link 16.

The boom 11 is vertically shaken by power generated by a boom cylinder 13. The boom cylinder 13 is actuated by hydraulic fluid discharged from a hydraulic pump 31. The boom cylinder 13 is a hydraulic cylinder that vertically shakes the boom 11. One end portion of the boom cylinder 13 is connected to the vehicle body 2. The other end portion of the boom cylinder 13 is connected to the boom 11.

The bucket 12 is a work tool having a distal end portion 12B including a blade edge. The bucket 12 is arranged on a more front side than the front tires 6F are. The bucket 12 is connected to the distal end portion of the boom 11. The bucket 12 is shaken by power generated by a bucket cylinder 14. The bucket cylinder 14 is a hydraulic cylinder that shakes the bucket 12. The bucket cylinder 14 is actuated by hydraulic fluid discharged from a hydraulic pump 31. A center portion of the bell crank 15 is rotatably connected to the boom 11. One end portion of the bucket cylinder 14 is connected to the vehicle body 2. The other end portion of the bucket cylinder 14 is connected to one end portion of the bell crank 15. The other end of the bell crank 15 is connected to the bucket 12 via the bucket link 16.

The bucket 12 is connected to the distal end portion of the boom 11 via a connecting pin 12P. The one end portion of the bucket cylinder 14 is connected to the vehicle body front portion 2F via a connecting pin (not illustrated). The other end portion of the bucket cylinder 14 is connected to the one end portion of the bell crank 15 via a connecting pin 15P. The other end portion of the bell crank 15 is connected to one end portion of the bucket link 16 via a connecting pin 15Q. The other end portion of the bucket link 16 is connected to the bucket 12 via a connecting pin 12Q.

A support member 17 is provided at an intermediate portion of the boom 11. The support member 17 supports the bell crank 15. An intermediate portion of the bell crank 15 is connected to the support member 17 via a connecting pin 15R. The bell crank 15 is rotated using the connecting pin 15R as a fulcrum.

With extension/contraction of the bucket cylinder 14, the bell crank 15 is rotated using the connecting pin 15R as the fulcrum, and the bucket 12 is rotated using the connecting pin 12P as a fulcrum. An angle of the bucket 12 centering the connecting pin 12P is changed by shaking the bucket 12 using the connecting pin 12P as the fulcrum. In other words, an attitude of the bucket 12 is changed by extension/contraction of the bucket cylinder 14, and the bucket 12 performs a dumping movement or a tilting movement.

When the bucket cylinder 14 is contracted, the bell crank 15 is rotated using the connecting pin 15R as the fulcrum such that the one end portion of the bell crank 15 is moved rearward and the other end portion of the bell crank 15 is moved forward. When the other end of the bell crank 15 is moved forward, the bucket 12 is pushed forward by the bucket link 16. The bucket 12 performs a dumping movement by the bucket 12 being pushed forward by the bucket link 16.

When the bucket cylinder 14 is extended, the bell crank 15 is rotated using the connecting pin 15R as the fulcrum such that the one end portion of the bell crank 15 is moved forward and the other end of the bell crank 15 is moved rearward. When the other end of the bell crank 15 is moved rearward, the bucket 12 is pulled rearward by the bucket link 16. The bucket 12 performs a tilting movement by the bucket 12 being pulled rearward by the bucket link 16.

The dumping movement of the bucket 12 represents a movement in which the bucket 12 is rotated using the connecting pin 12P as the fulcrum such that an opened portion 12M of the bucket 12 faces downward and the distal end portion 12B is moved close to the ground RS. The tilting movement of the bucket 12 represents operation in which the bucket 12 is rotated using the connecting pin 12P as the fulcrum such that the opened portion 12M faces upward and the distal end portion 12B is moved away from the ground RS. With execution of the dumping movement of the bucket 12, the earth and sand scooped up by the bucket 12 is unloaded from the bucket 12. With execution of the tilting movement of the bucket 12, the bucket 12 scoops up the earth and sand.

The operating room 3R is provided with: an operator's seat on which an operator is seated; and an operating device 7 operated by the operator. The operating device 7 includes an accelerator pedal, a brake pedal, a steering lever, a forward/backward travel changeover switch, and a work machine operating lever.

An operator can perform changeover between driving, braking, swinging, and forward/backward traveling of the travel device 4 by operating the accelerator pedal, brake pedal, steering lever, and forward/backward travel changeover switch of the operating device 7.

The operator can perform driving, braking, and adjustment of a travel speed of the travel device 4 by operating the accelerator pedal and brake pedal of the operating device 7. The operator can swing the wheel loader 1 by operating the steering lever of the operating device 7 and can perform changeover between forward and backward traveling of the wheel loader 1 by operating a forward/backward changeover lever.

The operator can actuate the boom cylinder 13 and the bucket cylinder 14 by operating the work machine operating lever of the operating device 7. The boom 11 performs a lifting movement or a lowering movement by extension/contraction of the boom cylinder 13. The bucket 12 performs a tilting movement or a dumping movement by extension/contraction of the bucket cylinder 14.

[Control System]

Figure 2:
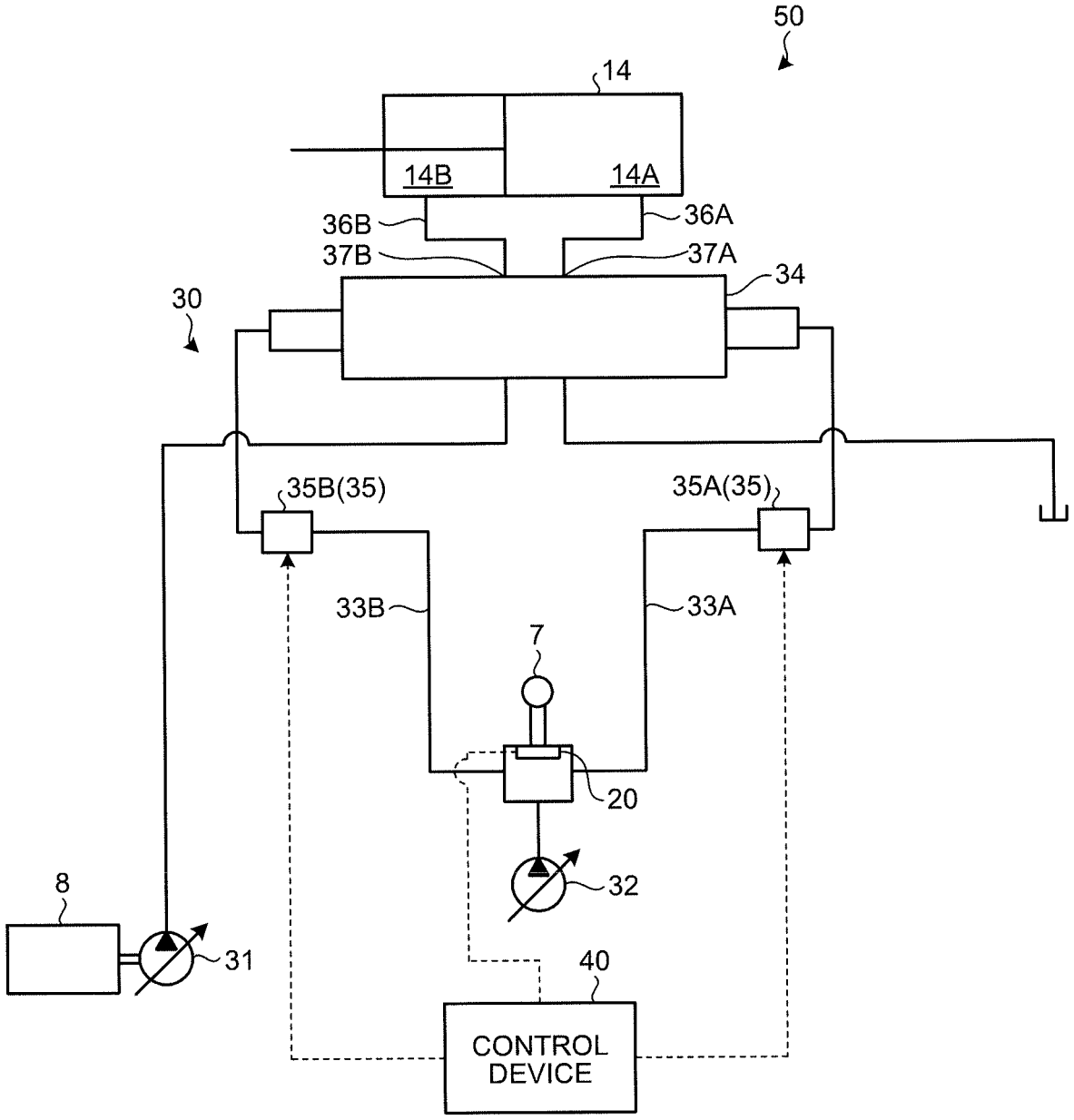
FIG. 2 is a diagram schematically illustrating an exemplary control system according to the present embodiment.

FIG. 2 is a diagram schematically illustrating an exemplary control system 50 according to the present embodiment. The control system 50 is mounted on the wheel loader 1. The control system 50 includes: a hydraulic device 30 that adjusts a supply state of the hydraulic fluid supplied to each of the boom cylinder 13 and bucket cylinder 14; and a control device 40 that controls the hydraulic device 30. The hydraulic device 30 illustrated in FIG. 2 adjusts the supply state of the hydraulic fluid supplied to the bucket cylinder 14 that makes the bucket 12 perform a movement. The control device 40 includes a computer system. The supply state of the hydraulic fluid includes at least one of: a state of increasing/decreasing a flow rate of the hydraulic fluid supplied in order to extend or contract the bucket cylinder 14 up to an operating limit position (stroke end); and a state of increasing/decreasing a flow rate of the hydraulic fluid supplied per unit time in order to extend or contract the bucket cylinder 14 up to the operating limit position (stroke end).

Figure 3:
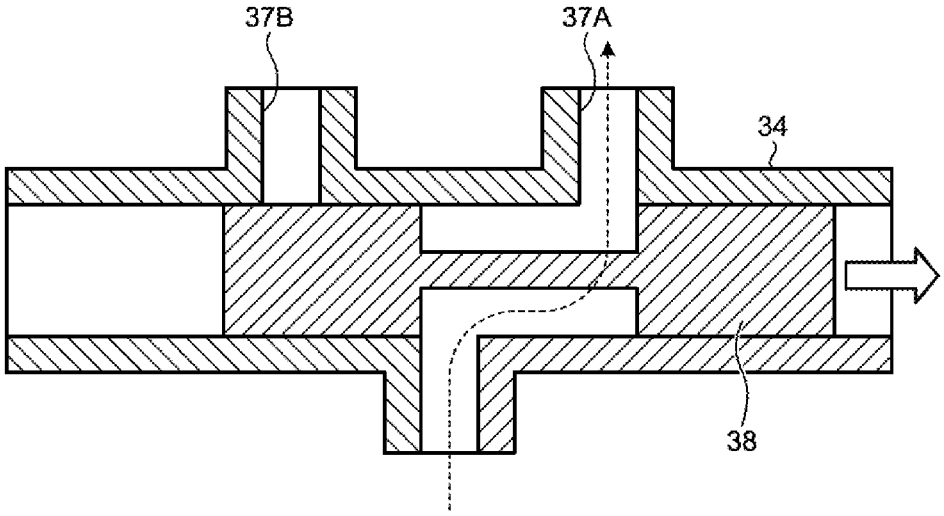
FIG. 3(A) and FIG. 3(B) are diagrams schematically illustrating a flow rate control valve according to the embodiment.
Figure 3:
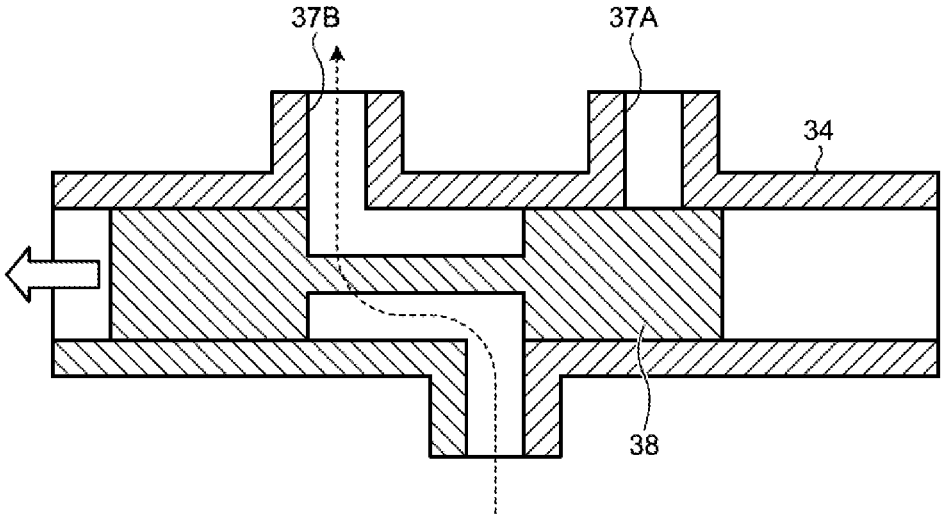

The hydraulic device 30 includes: the hydraulic pump 31 to supply the hydraulic fluid; a hydraulic pump 32 to supply pilot oil; oil passages 33A and 33B through which the pilot oil flows; and a spur 38 (see FIG. 3(A) and FIG. 3(B)), and further includes: a flow rate control valve 34 to adjust a flow rate and a direction of the hydraulic fluid supplied to the bucket cylinder 14 by movement of the spur 38; and control valves 35 (control valves 35A and 35B) to adjust force to move the spur 38. A pilot pressure acts on the flow rate control valve 34 by the pilot oil flowing through the oil passages 33A and 33B. In the present embodiment, the force to move the spur 38 is the pilot pressure. The control valves 35A and 35B adjust the pilot pressure acting on the spur 38.

The pilot oil discharged from the hydraulic pump 32 is supplied to the operating device 7. Note that the pilot oil that is discharged from the hydraulic pump 31 and has the pressure reduced by a pressure reducing valve may also be supplied to the operating device 7. The operating device 7 includes a pilot pressure regulating valve like a rotary valve. The pilot oil discharged from the hydraulic pump 32 is supplied to the flow rate control valve 34 via the operating device 7 and the oil passages 33A and 33B.

The bucket cylinder 14 has a piston-side oil chamber 14A and a rod-side oil chamber 14B. The hydraulic fluid discharged from the hydraulic pump 31 is supplied to the bucket cylinder 14 via the flow rate control valve 34. When the hydraulic fluid is supplied to the piston-side oil chamber 14A via a port 37A of the flow rate control valve 34 and an oil passage 36A, the bucket cylinder 14 is extended. When the hydraulic fluid is supplied to the rod-side oil chamber 14B via a port 37B of the flow rate control valve 34 and an oil passage 36B, the bucket cylinder 14 is contracted.

The operating device 7 includes the work machine operating lever, and the work machine operation lever is operated by an operator in order to make the bucket 12 perform a dumping movement and a tilting movement. When the work machine operating lever of the operating device 7 is operated so as to be fall down in a first operating direction (e.g., forward), the bucket cylinder 14 is contracted and the bucket 12 performs the dumping movement. When the work machine operating lever of the operating device 7 is operated so as to fall down in a second operating direction (e.g., backward), the bucket cylinder 14 is extended and the bucket 12 performs the tilting movement.

Additionally, when the work machine operating lever of the operating device 7 is operated in the first operating direction, a cylinder stroke indicating a contraction amount of the bucket cylinder 14 is changed on the basis of an operation amount of the work machine operating lever of the operating device 7, and a rotation angle of the bucket 12 performing the dumping movement is changed. For example, when the work machine operating lever of the operating device 7 is operated with a large operation amount in the first operating direction, the bucket cylinder 14 is actuated with a large cylinder stroke, and the rotation angle of the bucket 12 performing the dumping movement is increased. When the work machine operating lever of the operating device 7 is operated with a small operation amount in the first operating direction, the bucket cylinder 14 is actuated with a small cylinder stroke, and the rotation angle of the bucket 12 performing the dumping movement is reduced.

Similarly, when the work machine operating lever of the operating device 7 is operated in the second operating direction, the cylinder stroke of the bucket cylinder 14 is changed on the basis of the operation amount of the work machine operating lever, and the rotation angle of the bucket 12 performing a tilting movement is changed.

Additionally, when the work machine operating lever of the operating device 7 is operated in the first operating direction, a cylinder speed of the bucket cylinder 14 is changed on the basis of an operation speed of the work machine operating lever, and a movement speed (rotation speed) of the bucket 12 performing the dumping movement is changed. For example, when the work machine operating lever of the operating device 7 is operated at a high operation speed in the first operating direction, the bucket cylinder 14 is actuated at a high cylinder speed and the movement speed of the bucket 12 performing the dumping movement becomes fast. When the work machine operating lever of the operating device 7 is operated at a low operation speed in the first operating direction, the bucket cylinder 14 is actuated at a low cylinder speed and the movement speed of the bucket 12 performing the dumping movement becomes slow.

Similarly, when the work machine operating lever of the operating device 7 is operated in the second operating direction, the cylinder speed of the bucket cylinder 14 is changed on the basis of the operation speed of the work machine operating lever, and the movement speed of the bucket 12 performing a tilting movement is changed.

The control system 50 includes an operation sensor 20 that detects operation data indicating an operation state of the operating device 7. The operation sensor 20 includes, for example, a potentiometer. The operation sensor 20 is provided in the operating device 7.

The operation data detected by the operation sensor 20 includes: an operation amount of the operating device 7 to make the bucket 12 perform a dumping movement or a tilting movement; an operating direction of the operating device 7 to make the bucket 12 perform the dumping movement or the tilting movement; and an operation time and an operation speed of the operating device 7 at the time of switching the bucket 12 from one movement out of the dumping movement and the tilting movement to the other movement. The operation data detected by the operation sensor 20 is output to the control device 40.

The control device 40 controls the control valves 35A and 35B on the basis of the operation data output from the operation sensor 20. The pilot pressure acting on the flow rate control valve 34 is adjusted by controlling the control valves 35A and 35B. With adjustment of the pilot pressure by the operating device 7, a moving amount, a moving speed, and a moving direction of the spur 38 in an axial direction are adjusted. Consequently, the supply state of the hydraulic fluid supplied to the bucket cylinder 14 is adjusted.

FIG. 3(A) and FIG. 3(B) are diagrams schematically illustrating the flow rate control valve 34 according to the present embodiment. The flow rate control valve 34 is a slide spur type flow rate control valve that switches a flow rate and a direction of the hydraulic fluid supplied to the bucket cylinder 14 by moving the rod-shaped spur 38 in the axial direction. Supply of the hydraulic fluid to the piston-side oil chamber 14A and supply of the hydraulic fluid to the rod-side oil chamber 14B are switched by moving the spur 38 in the axial direction. As illustrated in FIG. 3(A), when the spur 38 is moved to one side in the axial direction, a flow path indicated by a broken line arrow is formed, and the hydraulic fluid is discharged from the port 37A. The hydraulic fluid discharged from the port 37A is supplied to the piston-side oil chamber 14A. As illustrated in FIG. 3(B), when the spur 38 is moved to the other side in the axial direction, a flow path indicated by a broken line arrow is formed, and the hydraulic fluid is discharged from the port 37B. The hydraulic fluid discharged from the port 37B is supplied to the rod-side oil chamber 14B.

In other words, with movement of the spur 38 in the axial direction, an actuation direction of the bucket cylinder 14 is adjusted. A movement direction of the bucket 12 is adjusted by adjusting the actuation direction of the bucket cylinder 14. The movement direction of the bucket 12 includes: a first movement direction in which the bucket 12 performs a tilting movement; and a second movement direction in which the bucket 12 performs a dumping movement. The bucket 12 is moved in the first movement direction and performs the tilting movement by operating the operating device 7 in the first operating direction and supplying the hydraulic fluid to the piston-side oil chamber 14A of the bucket cylinder 14 to extend the bucket cylinder 14. The bucket 12 is moved in the second movement direction and performs the dumping movement by operating the operating device 7 in the second operating direction and supplying the hydraulic fluid to the rod-side oil chamber 14B of the bucket cylinder 14 to contract the bucket cylinder 14.

Additionally, the flow rate of the hydraulic fluid supplied to the bucket cylinder 14 per unit time is adjusted by movement of the spur 38 in the axial direction. The cylinder stroke or the cylinder speed of the bucket cylinder 14 is adjusted by adjusting the flow rate of the hydraulic fluid of the hydraulic fluid supplied to the bucket cylinder 14. The rotation angle or the movement speed of the bucket 12 is adjusted by adjusting the cylinder stroke or the cylinder speed of the bucket cylinder 14. The rotation angle of the bucket 12 indicates a shaking amount of the bucket 12, and the movement speed of the bucket 12 indicates the rotation speed (shaking speed) of the bucket 12.

Note that the operating device 7 is not necessarily the pilot pressure type. The operating device 7 may be an electronic lever type in which operation data detected by the operation sensor 20 is output to the control device 40 and a flow rate control valve 24 is electrically controlled on the basis of the control device 40.

[Movement of Bucket]

Figure 4:
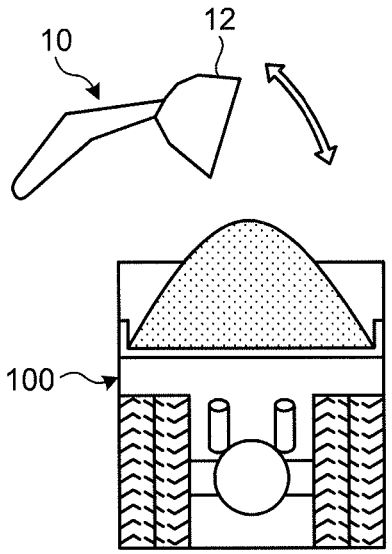
FIG. 4 is a diagram schematically illustrating exemplary movement of a bucket according to the embodiment.

FIG. 4 is a diagram schematically illustrating exemplary movement of the bucket 12 according to the present embodiment. The wheel loader 1 executes loading work to load earth and sand on a loading platform of a dump truck 100 by using the bucket 12 of the work machine 10. An operator of the wheel loader 1 operates the operating device 7 such that the bucket 12 performs a dumping movement at the time of unloading the earth and sand from the bucket 12. When remaining earth and sand adhere to the bucket 12 even after execution of the dumping movement, the operator may quickly operate the operating device 7 in a reciprocating manner in a full operation range of the operating device 7 such that the bucket 12 repeats a dumping movement and a tilting movement in order to shake off the earth and sand adhering to the bucket 12.

When the operating device 7 is quickly operated in a reciprocating manner in the full operation range, the bucket cylinder 14 quickly repeats an extended state up to an operating limit position (stroke end) and a contracted state up to an operating limit position (stroke end), and the bucket 12 performs a reciprocating motion between the operating limit position (stroke end) of the dumping movement and the operating limit position (stroke end) of the tilting movement. When such a reciprocating motion of the bucket is repeated between the operating limit position of the dumping movement and the operating limit position of the tilting movement in a short period of time, an excessive load may be given to at least a part of the work machine 10 at the operating limit position of the dumping movement or the operating limit position of the tilting movement. For example, there is a possibility that excessive stress acts on the support member 17 connected to the bell crank 15 via the connecting pin 15R, or excessive stress acts on the bell crank 15. When the excessive load is given to a part of the work machine 10, the work machine 10 may be damaged. In a case of preparing the work machine 10 in which a structure or a material that can withstand the load is applied, and weight increase or cost increase of the work machine 10 is caused.

In the following description, operation of the operating device 7 executed by an operator such that the bucket 12 quickly performs the reciprocating motion between the operating limit position of the dumping movement and the operating limit position of the tilting movement will be referred to as rapid operation as appropriate.

As described above, in the case of shaking off the earth and sand adhering to the bucket 12, an operator may rapidly repeat the dumping movement and the tilting movement of the bucket 12 by executing the rapid operation of the operating device 7 in the full operation range.

In the present embodiment, even in the case where the operator executes the rapid operation of the operating device 7, the control device 40 controls the control valves 35 such that the bucket 12 does not reach the operating limit position (stroke end) of the dumping movement and does not reach the operating limit position (stroke end) of the tilting movement in the dumping movement and the tilting movement of the bucket 12. In other words, when the operating device 7 is rapidly operated, the control device 40 controls the movement of the bucket 12 such that an excessive load is not given to at least a part of the work machine 10.

[Control Device]

Figure 5:
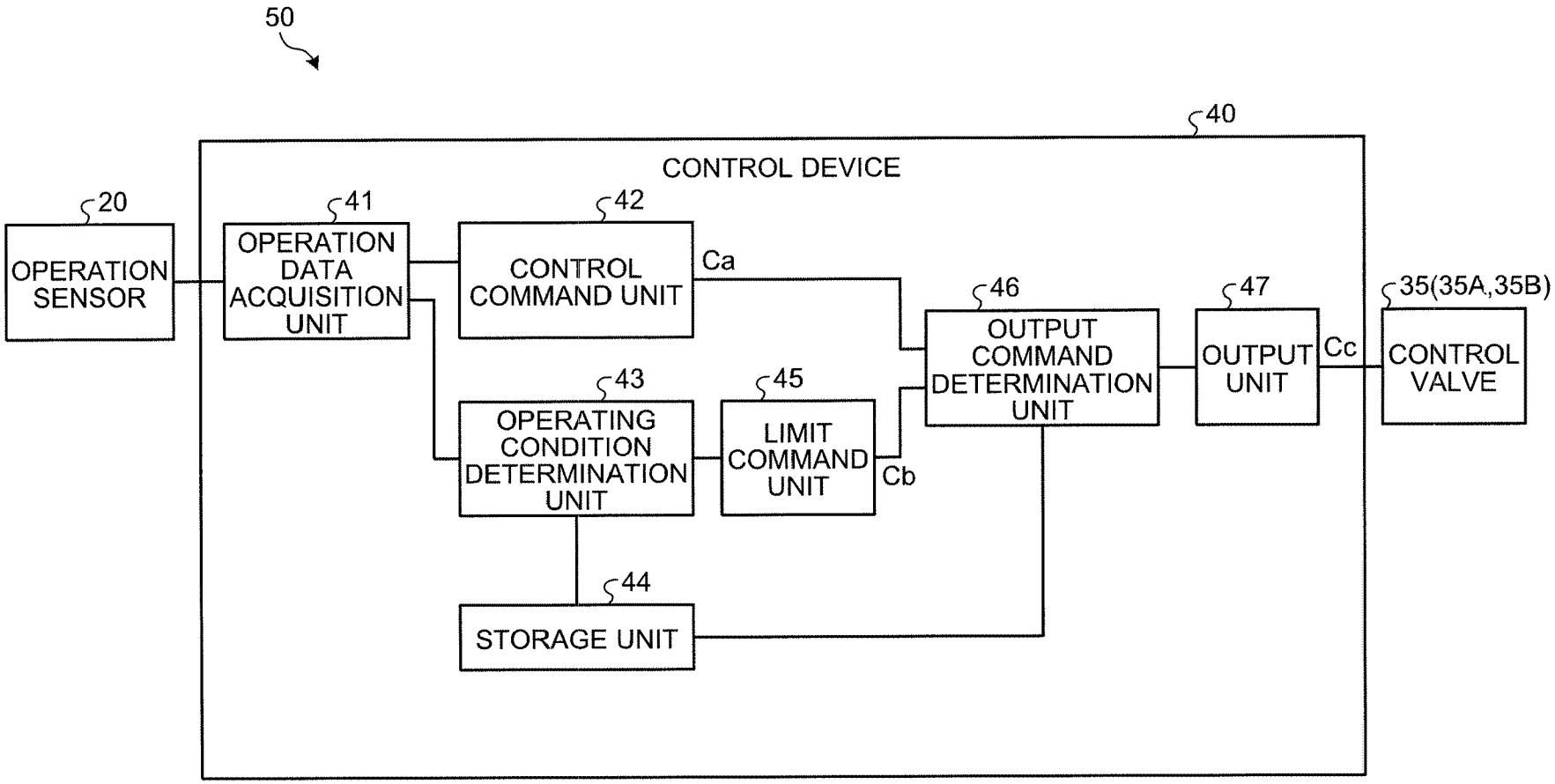
FIG. 5 is a functional block diagram illustrating a control device according to the present embodiment.

FIG. 5 is a functional block diagram illustrating the control device 40 according to the present embodiment. As illustrated in FIG. 5, the control device 40 includes an operation data acquisition unit 41, a control command unit 42, an operating condition determination unit 43, a storage unit 44, a limit command unit 45, an output command determination unit 46, and an output unit 47.

The operation data acquisition unit 41 acquires, from the operation sensor 20, operation data that is detected by the operation sensor 20 and indicates an operation state of the operating device 7 operated in order to make the bucket 12 perform a dumping movement and a tilting movement.

The control command unit 42 outputs a control command Ca in order to control the hydraulic device 30 on the basis of the operation data acquired by the operation data acquisition unit 41. The control command Ca includes a command value calculated on the basis of the operation amount.

The operating condition determination unit 43 determines, on the basis of the operation data acquired by the operation data acquisition unit 41, whether the operating device 7 is operated under prescribed operating conditions.

The prescribed operating conditions include: a first condition in which an operation amount of the operating device 7 to make the bucket 12 perform the dumping movement or the tilting movement is an operation amount threshold value a or more; a second condition in which an operating direction of the operating device 7 is switched prescribed number of times to make the bucket 12 perform the dumping movement and the tilting movement; and a third condition in which an operation time t (t1, t2) of the operating device 7 required to switch the bucket 12 from one movement out of the dumping movement and the tilting movement to the other movement is an operation time threshold value T (Ta, Tb) or less.

In the second condition, the number of times of switching the operating direction of the operating device 7 represents the number of times operating, in the first operating direction or the second operating direction, the operating device 7 operated in a reciprocating manner between the first operating direction and the second operating direction. When the operating device 7 currently operated to be a neutral state or in the second operating direction is operated in the first operating direction once, the number of switching times is once. When the operating device 7 currently operated to be the neutral state or in the first operating direction is operated in the second operating direction once, the number of switching times is once. When the operating device 7 currently operated to be the neutral state or in the second operating direction is operated in the second operating direction after being operated in the first operating direction, the number of switching times is twice. When the operating device 7 currently operated to be the neutral state or in the first operating direction is operated in the first direction after being operated in the second operating direction, the number of switching times is twice. When the operating device 7 currently operated to be the neutral state or in the second operating direction is operated in the first operating direction, subsequently operated in the second operating direction, and then operated in the first operating direction again, the number of switching times is three times. When the operating device 7 currently operated to be the neutral state or in the first operating direction is operated in the second operating direction, subsequently operated in the first direction, and then operated in the second operating direction again, the number of switching times is three times.

The prescribed number of times set as the second condition is a plurality of number of times. In the present embodiment, it is assumed that the prescribed number of times set as the second condition is three times. Note that the prescribed number of times set as the second condition may also be twice or may be arbitrary number of times that is four times or more.

The storage unit 44 stores the operation amount threshold value a and the operation time threshold value T. The operation amount threshold value a and the operation time threshold value T are predetermined values.

When the operating condition determination unit 43 determines that the operating device 7 is operated under the operating conditions, the limit command unit 45 outputs a limit command Cb to limit the control command Ca. The limit command Cb includes a limit value to limit a command value defined by the control command Ca.

The supply state of the hydraulic fluid supplied to the bucket cylinder 14 includes a flow rate of the hydraulic fluid supplied to the bucket cylinder 14. The limit command unit 45 outputs the limit command Cb such that the hydraulic fluid is supplied at a flow rate smaller than a flow rate of the hydraulic fluid supplied to the bucket cylinder 14 on the basis of the control command Ca. In other words, the limit command unit 45 outputs the limit command Cb such that the bucket cylinder 14 is actuated with a cylinder stroke smaller than a cylinder stroke of the bucket cylinder 14 actuated on the basis of the control command Ca.

The output command determination unit 46 compares the command value defined by the control command Ca with the limit value defined by the limit command Cb, and determines one of the control command Ca and the limit command Cb as an output command Cc to be output to the hydraulic device 30.

The output unit 47 outputs, to the hydraulic device 30, the output command Cc determined by the output command determination unit 46. The output unit 47 outputs then output command Cc to the control valves 35.

In a case where a command value is out of a limit value range, the output command determination unit 46 determines the limit command Cb as the output command Cc, and in a case where the command value is within the limit value range, the output command determination unit determines the control command Ca as the output command Cc. In other words, in a case where a command value is out of the limit value range by comparing the command value defined by the control command Ca with the limit value defined by the limit command Cb, the limit command Cb is output as the output command Cc to be output from the output unit 47 to the control valves 35. In a case where a command value is within the limit value range by comparing the command value defined by the control command Ca with the limit value defined by the limit command Cb, the control command Ca is output as the output command Cc to be output from the output unit 47 to the control valves 35.

[Output Command]

Figure 6:
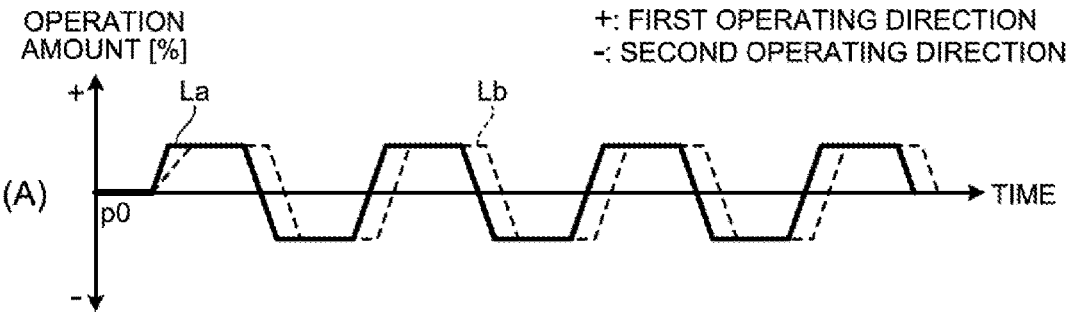
FIG. 6(A) and FIG. 6(B) are diagrams to describe a control method according to the embodiment.
Figure 6:
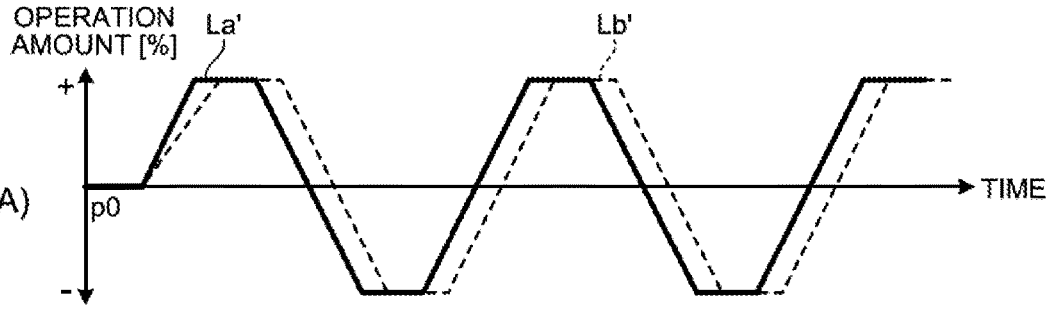
Figure 7:
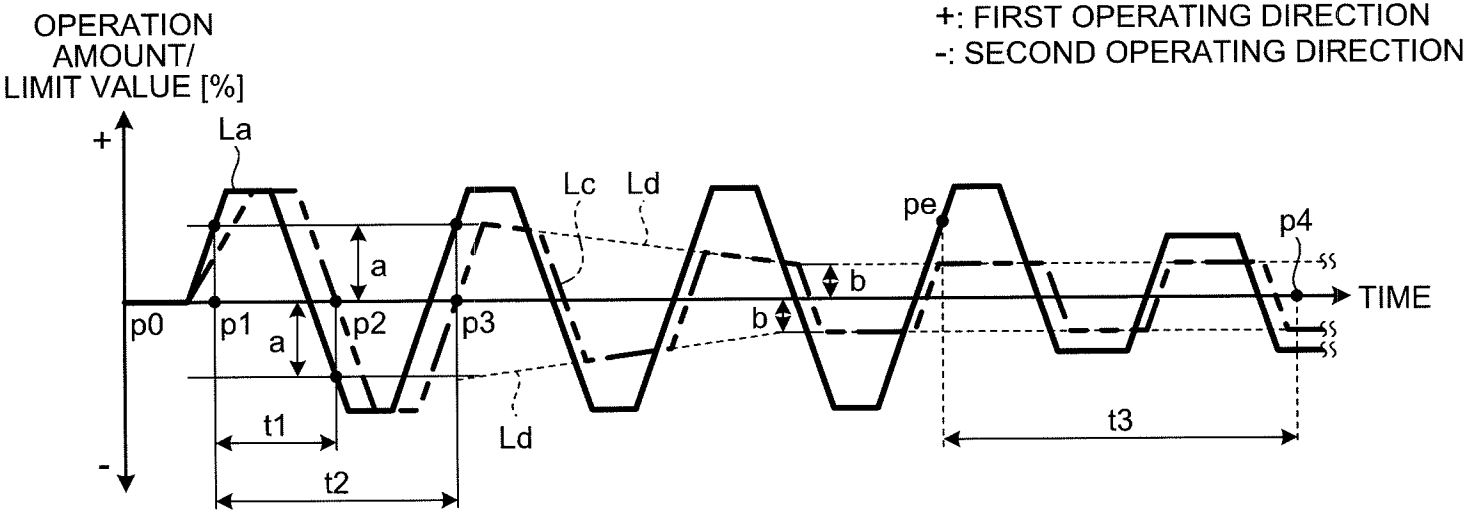
FIG. 7 is a diagram to describe the control method according to the embodiment.

Each of FIGS. 6 and 7 is a diagram illustrating an exemplary output command Cc according to the present embodiment. In each of FIGS. 6 and 7, a vertical axis represents an operation amount of the operating device 7, and a horizontal axis represents an elapsed time from a reference time point.

FIG. 6(A) and FIG. 6(B) are diagrams illustrating an output command Cc when the operating device 7 is not operated under the prescribed operating conditions. Meanwhile, FIG. 6(A) illustrates a case where the operating device 7 is operated in a reciprocating manner within a range not reaching the full operation range, and FIG. 6(B) illustrates a case where the operating device 7 is operated in a reciprocating manner in the full operation range but is slowly operated over time.

In FIG. 6(A) and FIG. 6(B), each of a line La and a line La' indicated by a solid line indicates detection data of the operation sensor 20. When the operating device 7 is operated in the first operating direction (e.g., forward), the operation amount of the operating device 7 detected by the operation sensor 20 exhibits a positive value. When the operating device 7 is operated in the second operating direction (e.g., backward), the operation amount of the operating device 7 detected by the operation sensor 20 exhibits a negative value. In other words, FIG. 6(A) and FIG. 6(B) illustrate the state in which the operating device 7 is operated in a reciprocating manner such that the bucket 12 repeats a dumping movement and a tilting movement.

In FIG. 6(A) and FIG. 6(B), each of dotted line Lb and the line Lb' indicates the output command Cc. The output command Cc is generated slightly more delayed than operation of the operating device 7. Therefore, in FIG. 6(A) and FIG. 6(B), the line Lb and line Lb' are illustrated in a manner delayed more than the line La and line La' both indicating the detection data of the operation sensor 20. Similarly, in FIG. 7, a line Lc indicating an output command Cc is illustrated in a manner delayed more than a line La indicating detection data of the operation sensor 20.

When the operating device 7 is not operated under the prescribed operating conditions, a control command Ca output from the control command unit 42 is output to the control valves 35 as the output command Cc.

In other words, in a case where it is not determined that the operating device 7 is operated under the operating conditions, the output command determination unit 46 determines the control command Ca as the output command Cc.

FIG. 7 is the diagram illustrating the output command Cc when the operating device 7 is operated under the prescribed operating conditions. In FIG. 7, a solid line La indicates detection data of the operation sensor 20. Similar to FIG. 6(A) and FIG. 6(B), when the operating device 7 is operated in the first operating direction (e.g., forward), the operation amount of the operating device 7 detected by the operation sensor 20 exhibits a positive value. When the operating device 7 is operated in the second operating direction (e.g., backward), the operation amount of the operating device 7 detected by the operation sensor 20 exhibits a negative value.

A thick broken line Lc indicates the output command Cc. When the operating device 7 is operated under the prescribed operating conditions, a control command Ca output from the control command unit 42 is limited by the limit command unit 45 as a limit command Cb, and the limit command Cb is output as the output command Cc to the control valves 35.

The prescribed operating conditions include a condition of satisfying all of the first condition, second condition, and third condition.

The first condition represents a condition in which the operation amount of the operating device 7 detected by the operation sensor 20 is the operation amount threshold value a or more The second condition represents a condition in which the operating direction of the operating device 7 is switched the prescribed number of times to make the bucket 12 perform a dumping movement or a tilting movement. In the present embodiment, the operation amount threshold value a is a value of 90% of a maximum value of the operation amount that can be operated by the operating device 7. In the present embodiment, the second condition represents a condition in which the operation direction of the operating device 7 is switched three times.

In the example illustrated in FIG. 7, an operation amount at the time of operating the operating device 7 in the first operating direction such that the bucket 12 performs a dumping movement from a reference time point p0 exceeds the operation amount threshold value a. An operation amount at the time of operating the operating device 7 in the second operating direction after operating the operating device 7 in the first operating direction such that the bucket 12 performs a tilting movement also exceeds the operation amount threshold value a. An operation amount at the time of continuously operating the operating device 7 in the first operating direction after operating the operating device 7 in the second operating direction such that the bucket 12 performs the dumping movement also exceeds the operation amount threshold value a. Therefore, the example illustrated in FIG. 7 satisfies the first condition and the second condition.

The third condition includes a third condition in which the operation time t (t1, t2) of the operating device 7 required to switch the bucket 12 from one movement out of the dumping movement and the tilting movement to the other movement is less than the operation time threshold value T (Ta, Tb). When a time point at which the operation mount exceeds the operation amount threshold value a at the time of operating the operating device 7 in the first operating direction is defined as p1, and a time point at which the operation amount exceeds the operation amount threshold value a at the time of continuously operating the operating device 7 in the second operating direction is defined as p2, and a time point (control start time point) at which an operation amount exceeds the operation amount threshold value a at the time of continuously operating the operating device in the first operating direction is defined as p3, the operation time t includes a first operation time t1 from the time point p1 to the time point p2 and a second operation time t2 from the time point p1 to the control start time point p3. An operation time threshold value Ta related to the first operation time t1 is set to 0.25 seconds, for example, and an operation time threshold value Tb related to the second operation time t2 is set to 0.5 seconds, for example. The example illustrated in FIG. 7 represents a case where not only the first condition and the second condition but also the third condition are satisfied.

Meanwhile, the example illustrated in FIG. 7 is the case where the operating device 7 is initially operated in the first operating direction, but even in a case where the operating device 7 is initially operated in the second operating direction, when all of the first condition, second condition, and third condition are satisfied, the operating condition determination unit 43 determines that the operating device 7 is operated under the prescribed operating conditions.

The thick broken line Lc is output to the control valves 35 as the output command Cc until the control start time point p3. The limit command unit 45 outputs a limit command until a control finish time point p4 after elapse of a prescribed time from the control start time point p3 at which it is determined that the operating device 7 is operated under the operating conditions. A line Ld indicated by a thin broken line represents a limit value defined by a limit command. As indicated by the line Ld, the limit command unit 45 gradually reduces the limit value from the control start time point p3. Since the limit value is gradually reduced, the cylinder stroke of the bucket cylinder 14 becomes gradually small, and a movement amount of the bucket 12 is gradually reduced. Since the movement amount of the bucket 12 is not rapidly reduced, an operator of the wheel loader 1 is suppressed from feeling discomfort about a state that movement of the bucket 12 suddenly becomes non-smooth.

In the present embodiment, a minimum limit value b representing a minimum value of the limit value is determined. As indicated by the line Ld in FIG. 7, the limit command unit 45 continues outputting the minimum limit value b after the limit value reaches the minimum limit value b. The limit command unit 45 continues, without changing the minimum limit value b, outputting the minimum limit value b that is a constant value.

The limit command unit 45 outputs a limit command Cb until the control finish time point p4 after elapse of a control release preparation time t3 from a release preparation start time point pe indicating a time point at which the operating device 7 is determined to be operated under the prescribed operating conditions last time.

The release preparation start time point pe is a time point at which preparation for control release based on the limit command Cb is started. The control finish time point p4 is a time point at which the control based on the limit command Cb is released. The control release preparation time t3 is a period from the release preparation start time point pe to the control finish time point p4, which is a preset time.

In the present embodiment, the control finish time point p4 is a time point at which, for example, three seconds elapse as the control release preparation time t3 from the release preparation start time point pe at which the prescribed operating conditions are satisfied last time. In the example illustrated in FIG. 7, the release preparation start time point pe is a time point at which an operator of the wheel loader 1 operates the operating device 7 in the first operating direction and the operating condition are satisfied last time. Illustrated is a case where the operation amount does not exceed the operation amount threshold value a and falls in a state not satisfying the first condition despite a fact that the operating device 7 that has been operated in the first operating direction so as to satisfy the operating conditions is operated in the second operating direction after passing the release preparation start time point pe. In other words, FIG. 7 represents the example in which the bucket 12 that has performed the dumping movement up to the operating limit position at the release preparation start time point pe is operated so as not to be moved to the operating limit position in a next tilting movement.

When the time reaches the control finish time point p4, termination conditions for the control based on the limit command Cb are satisfied, and control returns to the control to extend/contract the bucket cylinder 14 on the basis of the control command Ca. In other words, the control returns to the control to extend/contract the bucket cylinder 14 in accordance with intention of an operator. When the operator stops the rapid operation, the control based on the limit command Cb is automatically released, and therefore, it is possible to promptly shift to ordinary excavation work or the like.

In the present embodiment, the limit value is gradually reduced in the state where the operating device 7 is operated under the prescribed operating conditions, and when the limit value reaches the minimum limit value b, the minimum limit value b is continuously output without changing the minimum limit value b. In a case where the operating device 7 is continuously operated for a long time so as to satisfy the prescribed operating conditions, the limit value is gradually reduced at an initial stage of the control based on the limit command Cb, and the minimum limit value b is continuously output to the control valves 35 from the output unit 47.

[Control Method]

Figure 8:
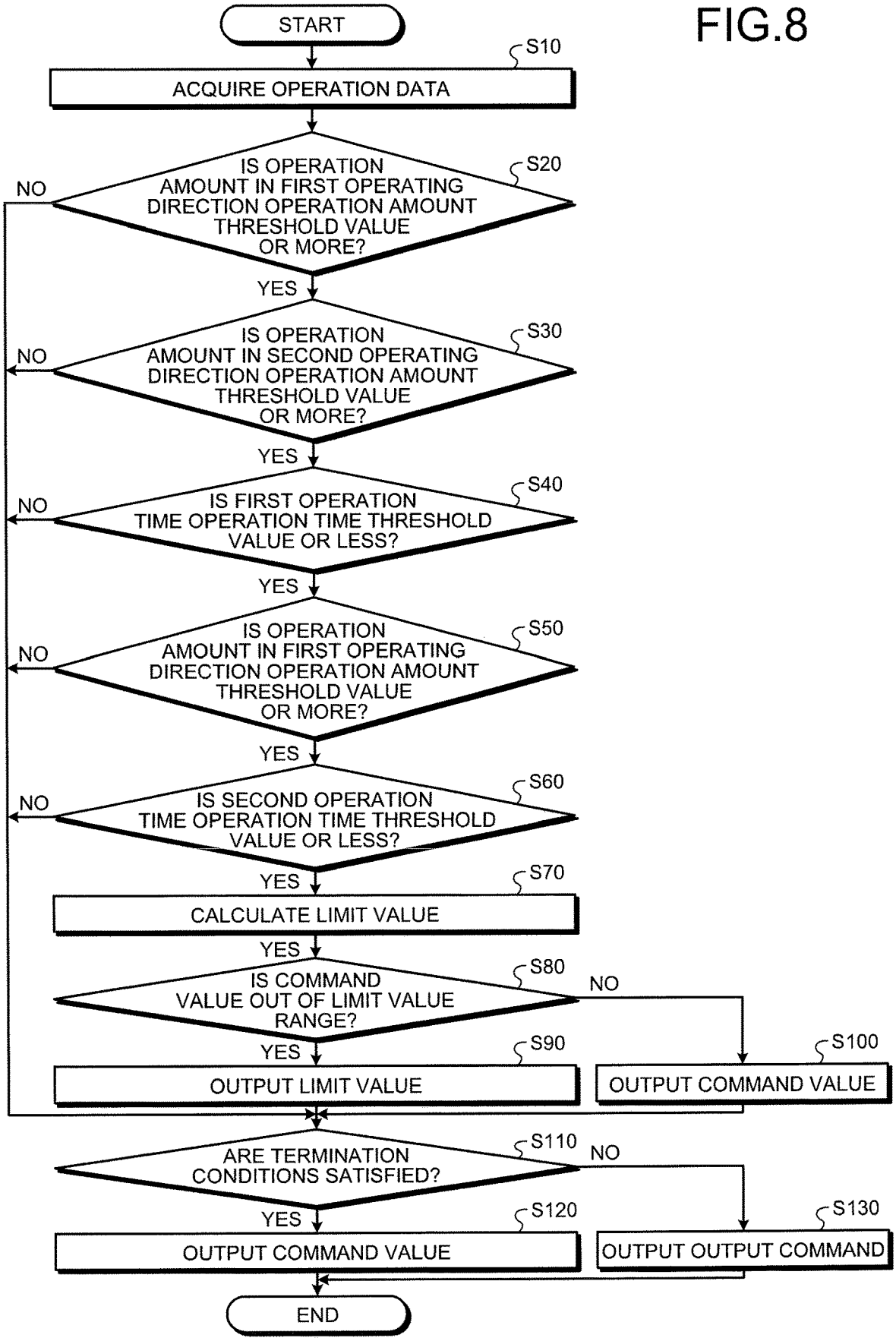
FIG. 8 is a flowchart illustrating the control method according to the present embodiment.

FIG. 8 is a flowchart illustrating a control method according to the present embodiment. The control device 40 repeats processing illustrated in FIG. 8 at a predetermined cycle.

The operation data acquisition unit 41 acquires operation data from the operation sensor 20 (step S10).

The operating condition determination unit 43 determines, on the basis of the operation data, whether an operation amount is the operation amount threshold value a or more when the operating device 7 is operated in the first operating direction (step S20).

In a case where it is determined in step S20 that the operation amount is the operation amount threshold value a or more (step S20: Yes), the operating condition determination unit 43 determines, on the basis of the operation data, whether an operation amount is the operation amount threshold value a or more when the operating device 7 is operated in the second operating direction (Step S30).

In a case where it is determined in step S30 that the operation amount is the operation amount threshold value a or more (step S30: Yes), the operating condition determination unit 43 determines, on the basis of the operation data, whether a first operation time t1 of the operating device 7 is equal to or less than 0.25 seconds, namely, an operation time threshold value Ta (step S40).

In a case where it is determined in step S40 that the first operation time t1 is the operation time threshold value Ta or less (step S40: Yes), the operation sensor 20 detects that the operating device 7 is operated, and the operation data acquisition unit 41 acquires operation data. The operating condition determination unit 43 determines, on the basis of the operation data, whether the operation amount is the operation amount threshold value a or more when the operating device 7 is operated in the first operating direction (step S50).

In a case where it is determined in step S50 that the operation amount is the operation amount threshold value a or more (step S50: Yes), the operating condition determination unit 43 determines whether a second operation time t2 of the operating device 7 is equal to or less than 0.5 seconds, namely, an operation time threshold value Tb on the basis of the operation data (step S60).

In a case where it is determined in step S60 that the second operation time t2 is the operation time threshold value Tb or less (step S60: Yes), the limit command unit 45 calculates a limit value to limit a command value defined by a control command Ca (Step S70).

The output command determination unit 46 determines whether a command value output from the control command unit 42 is out of a limit value range (step S80).

In a case where it is determined in step S80 that the command value is out of the limit value range (step S80: Yes), the output command determination unit 46 determines, as an output command Cc, a limit command Cb indicating a limit value. The output unit 47 outputs the limit command Cb indicating the limit value as the output command Cc (step S90).

In a case where it is determined in step S80 that the command value is within the limit value range (step S80: No), the output command determination unit 46 determines, as the output command Cc, the control command Ca indicating the command value. The output unit 47 outputs the control command Ca indicating the command value as the output command Cc (step S100).

The output command determination unit 46 determines whether termination conditions for the control based on the above-described limit command Cb are satisfied (step S110).

In a case where it is determined in step S110 that the termination conditions are not satisfied (step S110: No), the output unit 47 outputs the output command Cc determined in step S90 or the output command Cc determined in step S100 (step S130), and the processing returns to step S10.

In a case where it is determined in step S110 that the termination conditions are satisfied (step S110: Yes), the output unit 47 outputs the control command Ca as the output command Cc without changing the magnitude of the control command Ca in order to limit the control command Ca indicating the command value (step S120).

In the case where it is determined in step S20 that the operation amount in the first operating direction is not the operation amount threshold value a or more (step S20: No), in the case where it is determined in step S30 that the operation amount in the second operating direction is not the operation amount threshold value a or more (Step S30: No), in the case where it is determined in step S40 that the first operation time t1 is not the operation time threshold value Ta or less (step S40: No), in the case where it is determined in step S50 that the operation amount in the first operating direction is not the operation amount threshold value a or more (step S50: No), and in the case where it is determined that the second operation time t2 is not the operation time threshold value Tb or less (step S60: Yes), the processing in step S110 is executed.

[Computer System]

Figure 9:
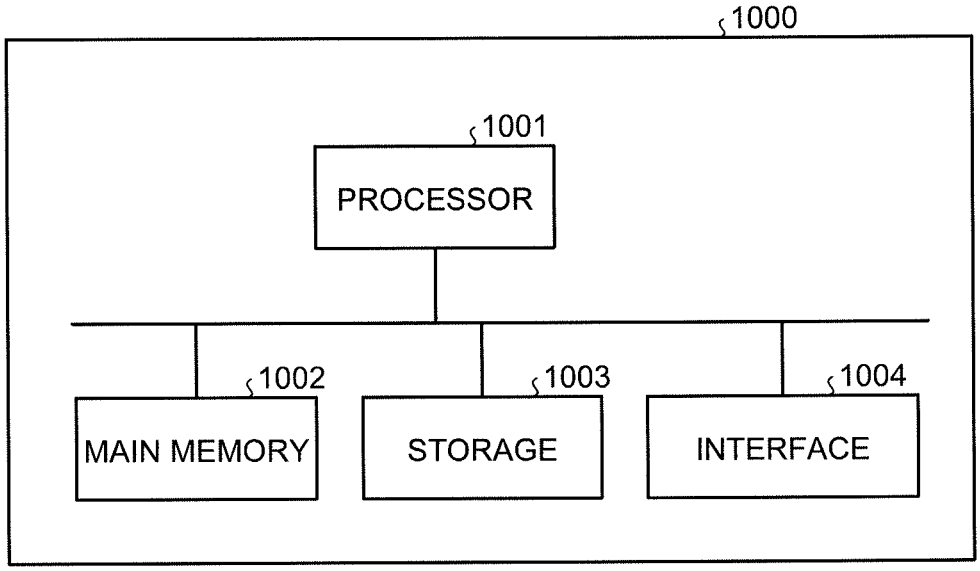
FIG. 9 is a block diagram illustrating a computer system according to the embodiment.

FIG. 9 is a block diagram illustrating an exemplary computer system 1000. The above-described control device 40 includes the computer system 1000. The computer system 1000 includes a processor 1001 like a central processing unit (CPU), a main memory 1002 including a nonvolatile memory like a read only memory (ROM) and a volatile memory like a random access memory (RAM), a storage 1003, and an interface 1004 including an input/output interface. The above-described functions of the control device 40 are stored in the storage 1003 as a program. The processor 1001 reads the program from the storage 1003, develops the program in the main memory 1002, and executes the above-described processing in accordance with the program. Note that the program may also be distributed to the computer system 1000 via a network.

[Effects]

As described above, according to the present embodiment, in a case where the operating device 7 is quickly operated such that the bucket 12 repeats a dumping movement and a tilting movement, that is, in a case where the operating device 7 is operated such that operation data satisfy the operating conditions, the limit command unit 45 outputs a limit command Cb to limit a control command Ca output on the basis of the operation data. Consequently, even when the operating device 7 is rapidly operated so as to satisfy the operating conditions, the bucket 12 is suppressed from quickly reciprocating between the operating limit position (stroke end) of the dumping movement and the operating limit position (stroke end) of the tilting movement. Therefore, a load acting on the work machine 10 can be reduced. In other words, even when an operator operates the operating device 7 such that the bucket 12 quickly performs the reciprocating motion between the operating limit position of the dumping movement and the operating limit position of the tilting movement, an excessive load acting on the work machine 10 is automatically suppressed.

In the present embodiment, in the case where the operating device 7 is quickly operated in the full operation range such the bucket 12 quickly performs the reciprocating motion between the operating limit position of the dumping movement and the operating limit position of the tilting movement, in other words, such that the operation data satisfies the operating conditions, control is executed to limit the cylinder stroke of the bucket cylinder 14 such that the movement of the bucket 12 does not reach the operating limit position of the dumping movement and the operating limit position of the tilting movement. The control to limit the cylinder stroke of the bucket cylinder 14 can suppress the operator from feeling discomfort in operating the operating device 7. For example, in the case where the movement speed of the bucket 12 is controlled to be slowed down by limiting the cylinder speed of the bucket cylinder 14 in order to suppress the excessive load from acting on the work machine 10, the bucket 12 performs the dumping movement and the tilting movement so as to slow down the operation speed of the operating device 7, and therefore, there is a possibility that the operator feels discomfort. According to the present embodiment, since the control to limit the cylinder stroke of the bucket cylinder 14 is executed, it is possible to suppress the operator from feeling discomfort in operating the operating device 7.

Other Embodiments

Meanwhile, in an embodiment described above, in a case where an operating device 7 is quickly operated in a full operation range such that operation data satisfies operating conditions, a limit command unit 45 may control a movement speed of a dumping movement or a tilting movement to be slowed down. In other words, in a case where the operation data satisfies the operating conditions, a limit command may be generated so as to slow down the movement speed of a bucket 12, and control by which a cylinder speed of a bucket cylinder 14 is limited may also be executed. In the case of slowing down the movement speed of the bucket 12, a control device 40 calculates a flow rate of hydraulic fluid supplied per unit time to the bucket cylinder 14 so as to slow down the movement speed of the bucket 12, and the control device generates a limit command on the basis of the calculated flow rate of the hydraulic fluid.

Note that a work vehicle 1 is assumed to be a wheel loader in the above-described embodiment. As far as the work vehicle 1 is provided with a work machine including a work tool like a bucket, and the work vehicle 1 may be at least one of a crawler loader, a dozer excavator, a wheel type excavator, and a crawler type excavator. For example, in a case where the work vehicle 1 is an excavator, when an operating device of the excavator is quickly operated in a reciprocating manner in a full operation range such that a bucket that is a work tool quickly performs a reciprocating motion between an operating limit position of a dumping movement and an operating limit position of a tilting movement, a load acting on the work machine is reduced by controlling a bucket cylinder in accordance with the above-described embodiment.

REFERENCE SIGNS LIST

1 WHEEL LOADER (WORK VEHICLE)
2 VEHICLE BODY
2F VEHICLE BODY FRONT PORTION
2R VEHICLE BODY REAR PORTION
3 CAB
3R OPERATING ROOM
4 TRAVEL DEVICE
5 WHEEL
5F FRONT WHEEL
5R REAR WHEEL
6 TIRE
6F FRONT TIRE
6R REAR TIRE
7 OPERATING DEVICE
8 ENGINE
9 ARTICULATION MECHANISM
10 WORK MACHINE

11 BOOM
12 BUCKET
12B DISTAL END PORTION
12M OPENED PORTION
12P CONNECTING PIN
12Q CONNECTING PIN
13 BOOM CYLINDER
14 BUCKET CYLINDER
14A PISTON-SIDE OIL CHAMBER
14B ROD-SIDE OIL CHAMBER
15 BELL CRANK
15P CONNECTING PIN
15Q CONNECTING PIN
15R CONNECTING PIN
16 BUCKET LINK
17 SUPPORT MEMBER
20 OPERATION SENSOR
30 HYDRAULIC DEVICE
31 HYDRAULIC PUMP
32 HYDRAULIC PUMP
33A OIL PASSAGE
33B OIL PASSAGE
34 FLOW RATE CONTROL VALVE
35 CONTROL VALVE
35A CONTROL VALVE
35B CONTROL VALVE
36A OIL PASSAGE
36B OIL PASSAGE
37A PORT
37B PORT
38 SPUR
40 CONTROL DEVICE
41 OPERATION DATA ACQUISITION UNIT
42 CONTROL COMMAND UNIT
43 OPERATING CONDITION DETERMINATION UNIT
44 STORAGE UNIT
45 LIMIT COMMAND UNIT
46 OUTPUT COMMAND DETERMINATION UNIT
47 OUTPUT UNIT
50 CONTROL SYSTEM
a OPERATION AMOUNT THRESHOLD VALUE
b MINIMUM LIMIT VALUE
Ca CONTROL COMMAND
Cb LIMIT COMMAND
Cc OUTPUT COMMAND
RS GROUND
t1 FIRST OPERATION TIME
t2 SECOND OPERATION TIME
t3 CONTROL RELEASE PREPARATION TIME

The invention claimed is:

1. A work vehicle control system comprising:

a hydraulic device configured to adjust a supply state of hydraulic fluid supplied to a hydraulic cylinder configured to cause a work tool to operate; and a control device configured to control the hydraulic device, wherein the control device includes:

an operation data acquisition unit configured to acquire operation data indicating an operation state of an operating device operated in order to cause the work tool to perform a dumping movement and a tilting movement;

a control command unit configured to output a control command to control the hydraulic device on the basis of the operation data;

an operating condition determination unit configured to determine, on the basis of the operation data, whether the operating device is operated with prescribed operating conditions; and a limit command unit configured to output a limit command to limit the control command in a case where it is determined that the operating device is operated with the operating conditions, wherein the operation data includes; an operation amount value of the operating device to cause the work tool to perform the dumping movement or the tilting movement; an operating direction of the operating device to cause the work tool to perform the dumping movement or the tilting movement, and an operation time of the operating device required to switch the work tool from one movement out of the dumping movement and the tilting movement to the other movement, and the operating conditions include: a first condition in which the operation amount value is an operation amount threshold value or more; a second condition in which the operation direction is switched prescribed number of times; and a third condition in which the operation time is an operation time threshold value or less.

2. The work vehicle control system according to claim 1, wherein the supply state of the hydraulic fluid includes a flow rate of hydraulic fluid supplied to the hydraulic cylinder, and the limit command unit is configured to output the limit command such that the hydraulic fluid is supplied at a flow rate smaller than a flow rate of the hydraulic fluid supplied to the hydraulic cylinder on the basis of the control command.

3. The work vehicle control system according to claim 1, wherein the control command includes a command value calculated on the basis of the operation amount value, the limit command includes a limit value to limit the command value, the control device includes:

an output command determination unit configured to compare the command value with the limit value and determine one of the control command and the limit command as an output command to be output to the hydraulic device; and an output unit configured to output, to the hydraulic device, the output command determined by the output command determination unit, and in a case where the command value is out of the limit value range, the output command determination unit determines the limit command as the output command, and in a case where the command value is within the limit value range, the output command determination unit determines the control command as the output command.

4. The work vehicle control system according to claim 1, wherein the limit command unit is configured to output the limit command until a control finish time point after elapse of a control release preparation time from a release preparation start time point indicating a time point at which the operating device is determined to be operated with the operating conditions last time.

5. The work vehicle control system according to claim 1, wherein the limit command unit is configured to gradually reduce the limit value from a control start time point indicating a time point at which the operating device is determined to be operated with the operating conditions.

6. The work vehicle control system according to claim 5, wherein a minimum limit value indicating a minimum value of the limit value is defined, and the limit command unit is configured to continue outputting the minimum limit value after the limit value reaches the minimum limit value.

7. The work vehicle control system according to claim 3, wherein the output command determination unit determines the control command as the output command in a case where the operating device is not determined to be operated with the operating conditions.

8. A work vehicle control method comprising:

acquiring operation data indicating an operation state of an operating device operated in order to cause a work tool of a work vehicle to perform a dumping movement and a tilting movement;

outputting, on the basis of the operation data, a control command to control a hydraulic device configured to adjust a supply state of hydraulic fluid supplied to a hydraulic cylinder configured to cause the work tool to operate;

determining, on the basis of the operation data, whether the operating device is operated with prescribed operating conditions; and outputting a limit command to limit the control command in a case where the operating device is determined to be operated with the operating conditions, wherein the operation data includes: an operation amount value of the operating device to cause the work tool to perform the dumping movement or the tilting movement; an operating direction of the operating device to cause the work tool to perform the dumping movement or the tilting movement; and an operation time of the operating device required to switch the work tool from one movement out of the dumping movement and the tilting movement to the other movement, and the operating conditions include: a first condition in which the operation amount value is an operation amount threshold value or more; a second condition in which the operation direction is switched prescribed number of times; and a third condition in which the operation time is an operation time threshold value or less.

9. The work vehicle control system according to claim 4, wherein the output command determination unit determines the control command as the output command in a case where the operating device is not determined to be operated with the operating conditions.

10. The work vehicle control system according to claim 5, wherein the output command determination unit determines the control command as the output command in a case where the operating device is not determined to be operated with the operating conditions.

* * * * *